US009113736B1

(12) United States Patent
Antler

(10) Patent No.: US 9,113,736 B1
(45) Date of Patent: Aug. 25, 2015

(54) SPACE SAVING HANGER

(71) Applicant: Steven M Antler, Darien, CT (US)

(72) Inventor: Steven M Antler, Darien, CT (US)

( * ) Notice: Subject to any disclaimer, the term of this patent is extended or adjusted under 35 U.S.C. 154(b) by 0 days.

(21) Appl. No.: 14/511,290

(22) Filed: Oct. 10, 2014

(51) Int. Cl.
*A41D 27/22* (2006.01)
*A47G 25/32* (2006.01)

(52) U.S. Cl.
CPC ..... *A47G 25/32* (2013.01)

(58) Field of Classification Search
CPC ..... A47G 25/26; A47G 25/30; A47G 25/32
USPC ..... 223/85, 88, DIG. 4
See application file for complete search history.

(56) References Cited

U.S. PATENT DOCUMENTS

| | | | | | |
|---|---|---|---|---|---|
| 1,551,769 | A * | 9/1925 | Paddington | 223/88 |
| 2,395,210 | A * | 2/1946 | Baril | 211/89.01 |
| 2,655,296 | A * | 10/1953 | Winzer | 223/88 |
| 2,819,829 | A * | 1/1958 | Gensmer et al. | 223/98 |
| 2,912,149 | A * | 11/1959 | Stuard | 223/92 |
| 4,168,791 | A * | 9/1979 | Clark, Jr. | 223/94 |
| 4,586,637 | A * | 5/1986 | Lemel | 223/92 |
| 4,728,016 | A * | 3/1988 | McPhee | 223/85 |
| 4,932,571 | A * | 6/1990 | Blanchard | 223/89 |
| 5,078,307 | A * | 1/1992 | Suddath | 223/92 |
| 5,085,357 | A * | 2/1992 | Chen | 223/89 |
| 5,649,652 | A * | 7/1997 | Sackett et al. | 223/85 |
| 5,785,216 | A * | 7/1998 | Gouldson et al. | 223/85 |
| D409,846 | S * | 5/1999 | Blanchard | D6/318 |
| 6,070,772 | A * | 6/2000 | Bond | 223/85 |
| 6,073,819 | A * | 6/2000 | Wing | 223/89 |
| 7,182,231 | B1 * | 2/2007 | Greiner | 223/85 |
| 7,624,900 | B2 * | 12/2009 | McLaughlin | 223/85 |
| 7,837,074 | B2 * | 11/2010 | Rude et al. | 223/94 |
| 2006/0175364 | A1 * | 8/2006 | Simpson et al. | 223/98 |
| 2008/0308586 | A1 * | 12/2008 | Liang | 223/85 |

* cited by examiner

*Primary Examiner* — Nathan Durham
(74) *Attorney, Agent, or Firm* — Shlesinger, Arkwright & Garvey LLP

(57) ABSTRACT

A space saving hanger comprises a frame for supporting a garment, the frame including a first arm portion and a second arm portion, the first and second arm portions extending outwardly and downwardly from a central portion of the frame; and a hook attached to the central portion, the hook including an extended position and a folded position, the hook extending upwardly from the central portion when in the extended position, and the hook extending downwardly from the central position when in the folded position.

19 Claims, 7 Drawing Sheets

SPACE SAVING HANGER

FIELD OF THE INVENTION

The present invention is generally directed to clothes hangers and in particular to compact clothes hangers for travel use.

SUMMARY OF THE INVENTION

The present invention provides a space saving hanger, comprising a frame for supporting a garment, the frame including a first arm portion and a second arm portion, the first and second arm portions extending outwardly and downwardly from a central portion of the frame; and a hook attached to the central portion, the hook including an extended position and a folded position, the hook extending upwardly from the central portion when in the extended position, and the hook extending downwardly from the central position when in the folded position.

DETAILED DESCRIPTION OF THE INVENTION

Figure 1:
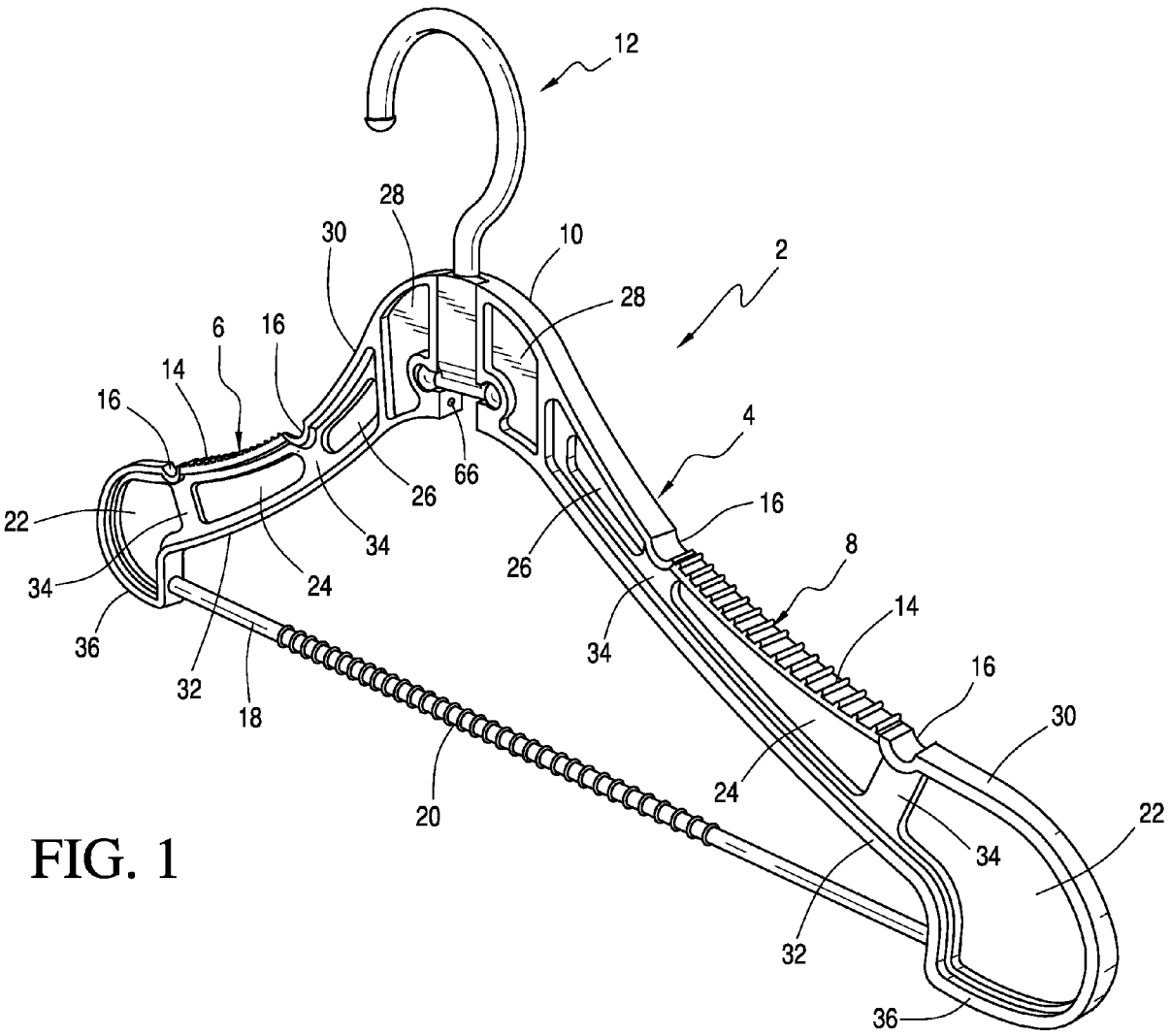
FIG. 1 is a perspective view of one side of a space saving hanger made in accordance with the present invention, showing the hanger in an extended position.
Figure 2:
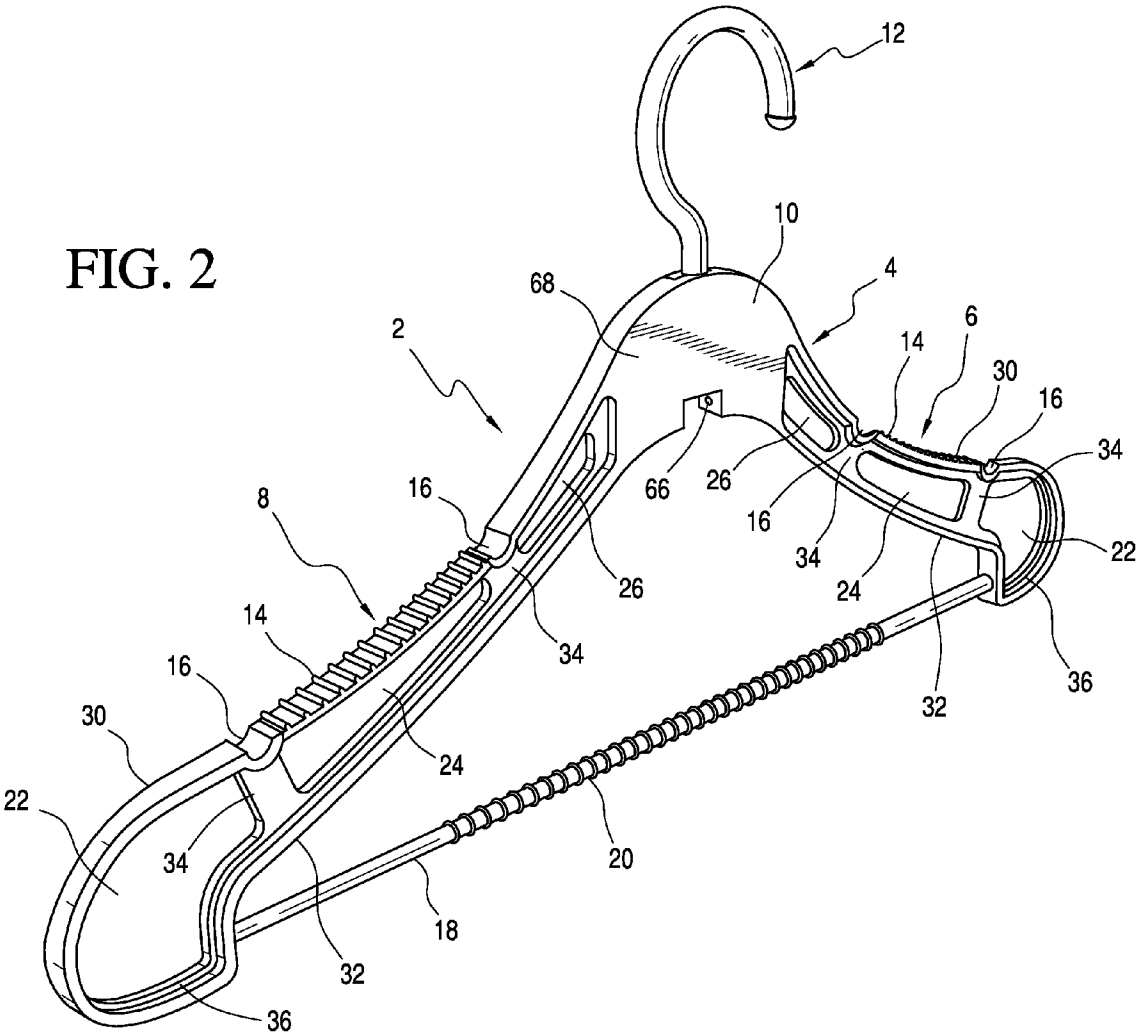
FIG. 2 is a perspective view of another side of the space saving hanger of FIG. 1.

A space saving hanger 2 made in accordance with the present invention is disclosed in FIGS. 1 and 2. The hanger 2 includes a frame 4 with arm portions 6 and 8 extending outwardly and downwardly from a central portion 10. A hook 12 is pivotably attached to the central portion 10.

The hook 12 extends upwardly in an extended position during normal use for hanging onto a hanging rod (not shown) in a closet or a bracket (not shown). The hook 12 further extends downwardly in a folded position (see FIG. 3) when being transported inside a garment bag along with a garment (see FIG. 12). The hook 12 in the folded position is opposite from the extended position, preferably about 180° apart from the extended position. Thus, the hanger 2 has an extended position when the hook 12 is extended, and a space saving folded position when the hook 12 is the folded position. The hanger 2 is in a compact configuration when in the folded position, thus saving space within the garment bag or storage box.

The hanger 2 is preferably made of plastic or other lightweight material.

Each of the arm portions 6 and 8 includes a plurality or series of ribs 14 evenly spaced apart and disposed transversely to the respective arm portions. The ribs 14 advantageously provide sliding resistance to the garment's tendency to slide down the respective arm portions 6 and 8. Slots 16 are provided on each of the arm portions 6 and 8 to hold straps attached to the garment, such as the straps of a woman's dress or the like. The slots 16 are preferably located at an upper portion and a lower portion of the respective arm portions 6 and 8 at both ends of the series of ribs 14.

A member 18 is attached to the lower ends of the respective arm portions 6 and 8. The member 18 is preferably circular in cross-section and provided with a series of circumferential ribs 20 evenly spaced apart. The ribs 20 advantageously provide sliding resistance to clothing, such as a pair of trousers, folded over the member 18 from the clothing's tendency to slide off the member.

Figure 3:
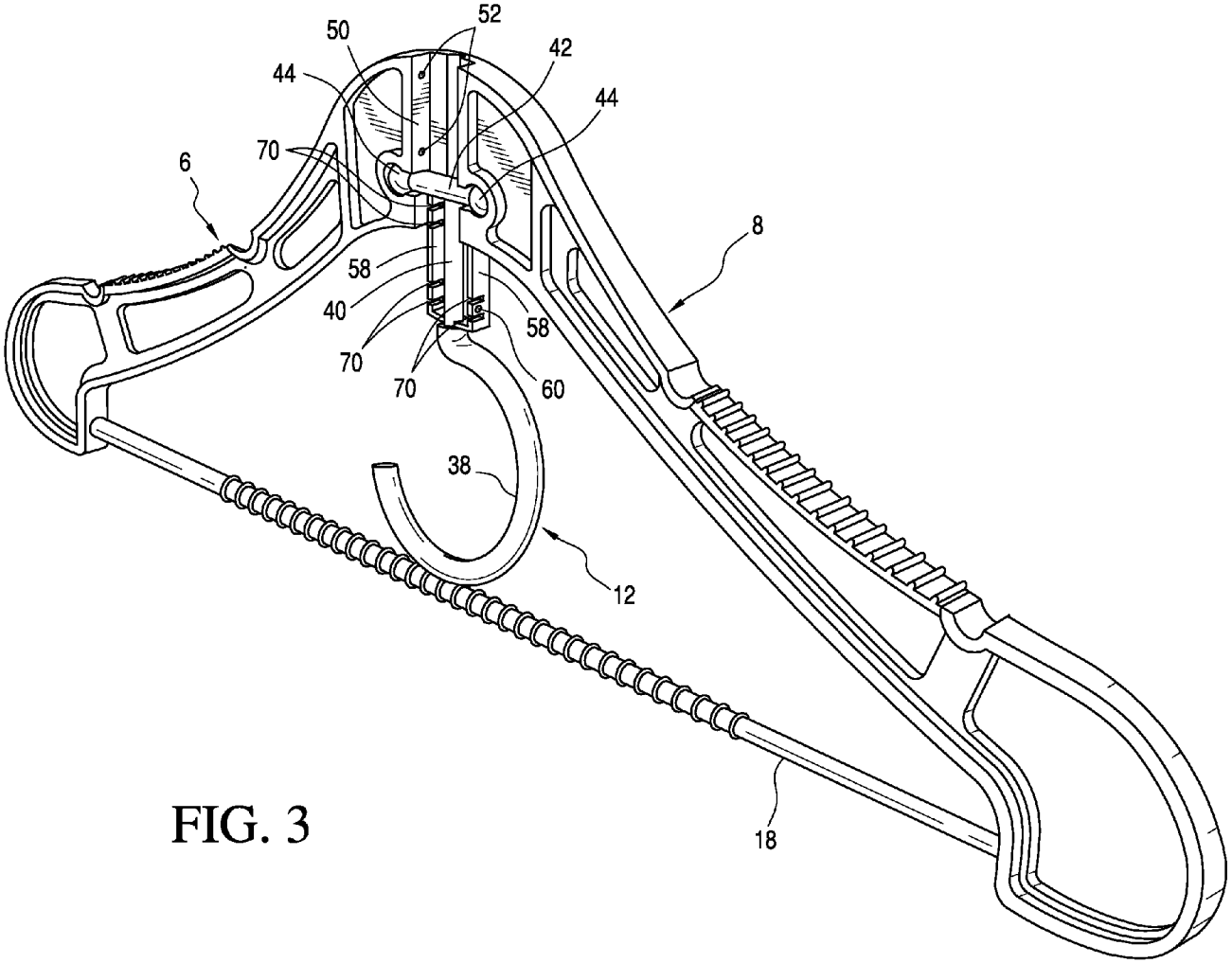
FIG. 3 is a perspective view of the space saving hanger of FIG. 1, showing the hanger in a folded position.

Referring to FIG. 3, the hook 12 when in the folded position is preferably disposed within the space and boundary defined by the arm portions 6 and 8 and the member 18 so that the hook 12 does not extend beyond the member 18 to minimize snagging the hook with other items and for a compact configuration for travel and storage.

The frame 4 is preferably provided with openings 22, 24 and 26 along the arm portions 6 and 8 to advantageously provide places to hang smaller clothing items, such as belts, neckties, scarves, etc. The openings also serve to save weight and material. The central portion 10 is hollowed at areas 28 to also save weight and material.

Each of the arm portions 6 and 8 is made of an upper member 30 and a lower member 32 separated from each other by struts 34. The upper member 30 and the lower member 32 are connected together at lower ends 36. The structure provides for the openings 22, 24 and 26.

Figure 4:
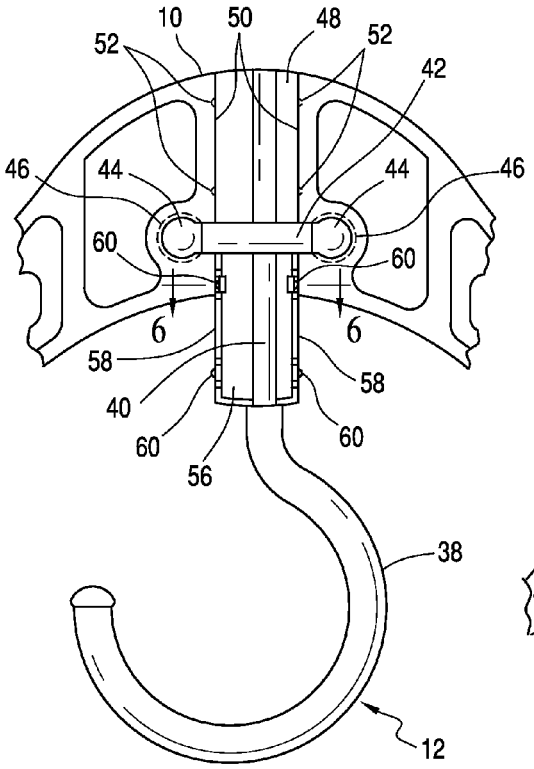
FIG. 4 is front elevational view of the hook in the folded position.

Referring to FIGS. 3 and 4, the hook 12 is shown in the folded position. The hook 12 includes a hook portion 38, a stem portion 40 and a shaft portion 42 attached transversely to the stem portion 40. Ball portions 44 are attached to the respective ends of the shaft portion 42. The ball portions 44 are rotatably received within respective sockets 46 in the central portion 10. The ball portions 44 are preferably snapped-in into the respective sockets 46. The shaft portion 42 is rotatable via the ball portions 44 rotating with the respective sockets 46 such that the hook 12 can be positioned in either the extended position or the folded position.

It should be understood that the rotation of the hook 12 can also be accomplished by eliminating the ball portions 44, extending the shaft at both ends and reconfiguring the sockets 46 to rotatably receive and retain the extended ends of the shaft 42.

A recess 48 is provided in the central portion 10 above the shaft portion 42 to receive the stem portion 40 when the hook 12 is in the extended position. The recess 48 has opposing side walls 50 with indentations or dimples 52. A cover 54 is attached to the stem portion 40 configured to cover the recess 48 when the hook 12 is in the extended position.

Figure 5:
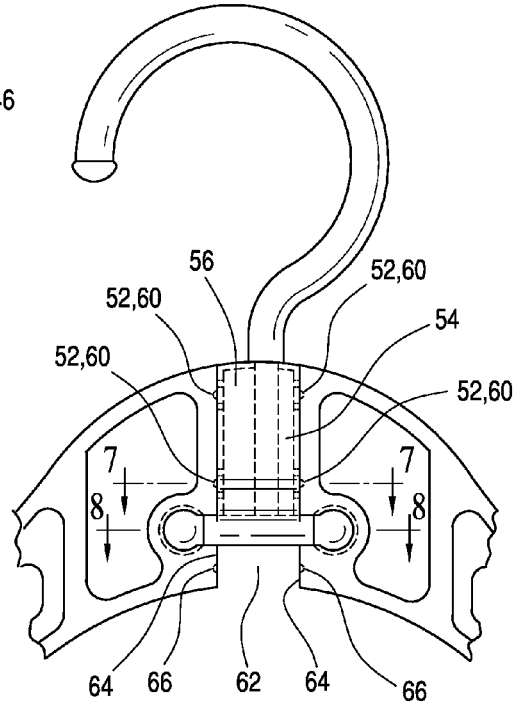
FIG. 5 is a front elevational view of the hook in the extended position.

Referring to FIGS. 4 and 5, the cover 54 has a base wall 56 with opposing side walls 58. Projections 60 are provided on the outside surfaces of the side walls 58 configured to be received within the respective indentations 52 when the hook 12 is in the extended position. The arrangement of the indentations 52 and the projections 60 serves as a locking means for locking the hook 12 in the extended position.

Locking the hook 12 in the extended position may also be accomplished by making the cover 54 slightly larger than the recess 48 to provide a frictional fit between the side walls 58 of the cover 54 and the side walls 50 of the recess 48.

A recess 62 is provided in the central portion 10 below the shaft portion 40 for receiving a portion of the cover 54 when the hook 12 is in the folded position. The recess 62 advantageously allows the hook 12 to rotate about 180° to the folded position and be disposed within the thickness of the frame 4. The recess 62 has opposing side walls 64, which are provided with indentations 66 that are configured to receive an opposing pair of the projections 60 nearer to the shaft portion 42 when the hook 12 is in the folded position, as shown in FIG. 4. The indentations 66 and the pair of projections 60 serve to lock the hook 12 in the folded position.

Locking the hook 12 in the folded position may also be accomplished by making the cover 54 slightly larger than the recess 62 to provide a frictional fit between the side walls 58 of the cover 54 and the side walls 64 of the recess 62.

Figure 6:
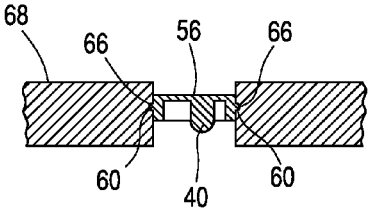
FIG. 6 is a cross-sectional view along line 6-6 in FIG. 4.

Referring to FIG. 6, the base wall 56 is preferably below the surface 68 and indented into the recess 62 when the hook 12 is in the folded position. In this manner, hook 12 is advantageously within the thickness of the frame 4 for a compact configuration, preventing the hook 12 from inadvertently being entangled with other parts of the clothing inside the garment bag or adjacent hanger during storage.

Referring to FIGS. 3 and 4, the side walls 50 are provided with slots 70 on either side of each projection 60 to provide a spring action to the projections 60 when they are snapped into or out of the respective indentations 52 or 66. The slots 70 are preferably disposed transversely to the base wall 56.

Figure 7:
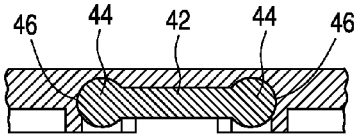
FIG. 7 is a cross-sectional view taken along line 7-7 in FIG. 5.

Referring to FIG. 7, the ball portions are shown received within the respective sockets 46.

Figure 8:
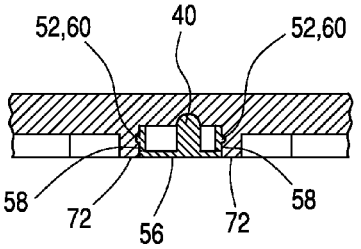
FIG. 8 is a cross-sectional view taken along line 8-8 in FIG. 5.

Referring to FIG. 8, the projections 60 are shown received within the respective indentations 52. The base wall 56 is preferably flush and aligned with the adjacent outside surface 72 of the central portion 10 for a finished look.

Figures 9, 11:
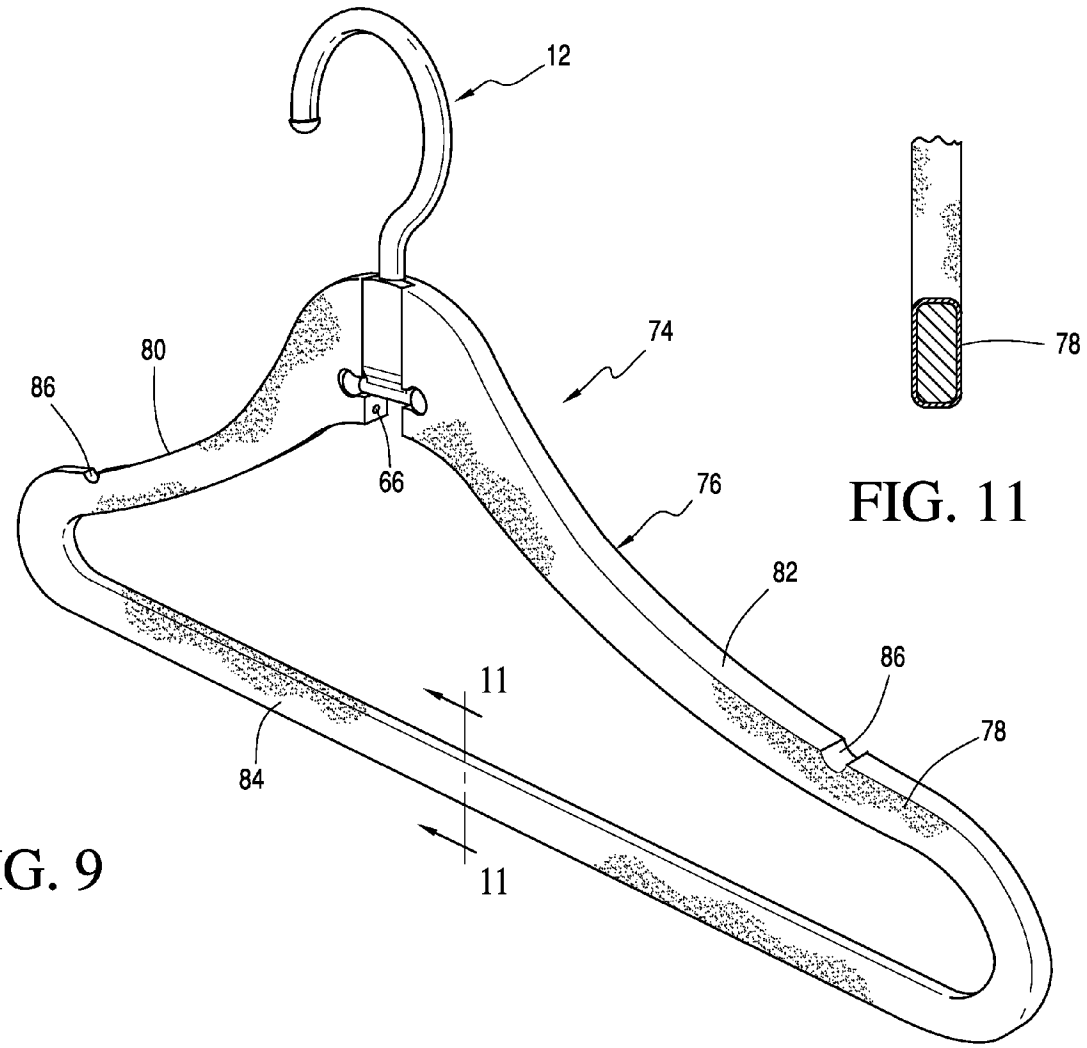
FIG. 9 is a perspective view of one side of another embodiment of a space saving hanger made in accordance with the present invention.
FIG. 11 is a cross-sectional view taken along line 11-11 in FIG. 9.
Figure 10:
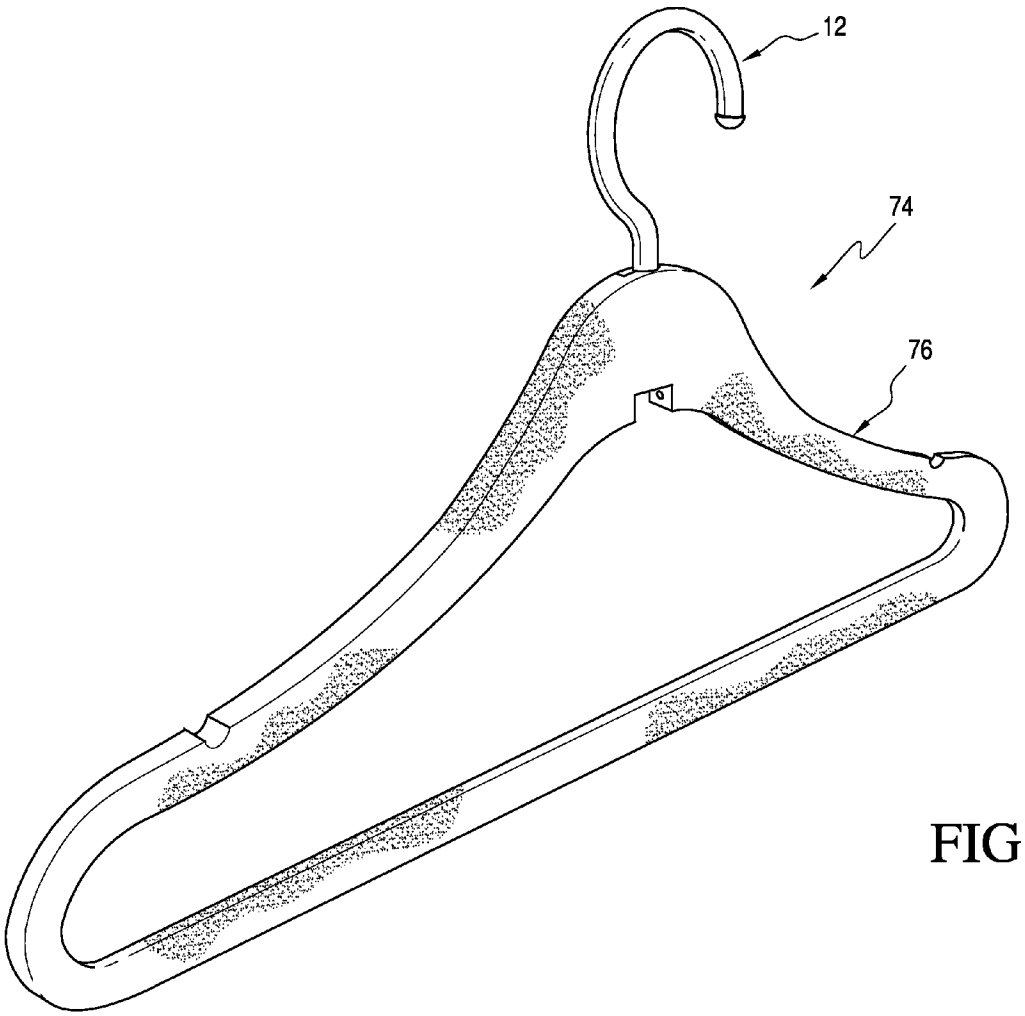
FIG. 10 is a perspective view of the other side of the space saving hanger of FIG. 9.

Referring to FIGS. 9, 10 and 11, another embodiment of a space saving hanger 74 is disclosed. The space saving hanger 74 also incorporates the same extendable and foldable hook 12 as already described above with the hanger 2. The hanger 74 includes a frame 76 covered with a non-slip layer 78 preferably velvet. Velvet is a soft fabric, such as silk, cotton, rayon, nylon, etc., having a smooth, dense pile and a plain underside. Velvet is preferred for the feel of delicateness and luxury that it imparts to the user. The layer 78 may also be made of other non-slip material, such as rubber. The layer 78 advantageously holds the garment hanging on the hanger with additional gripping to minimize sliding of the clothing off the hanger.

The layer 78 covers all the outside surfaces of the frame 76 for a uniform look; however, other surfaces that do not substantially contribute to holding the clothing on the hanger, such as the underside surfaces, may be left uncovered. Further, if desired, only the top edge surfaces of the frame 76 that directly support the weight of the clothing may be covered with the layer 78.

The frame 76 includes arm portions 80 and 82 and cross member 84. Recesses 86 advantageously secure clothing straps from sliding on the arm portions 80 and 82. The frame 76 is preferably made of plastic or other lightweight material, molded as a unitary, one-piece unit. The frame 76 is preferably rectangular and thin in cross-section and of uniform thickness to advantageously save space and be less bulky for travel use or storage. The hook 12 when in the folded position is preferably contained within the thickness of the frame 76 and the space defined by the frame 76 and the member 84. Similarly with the hanger 2, the hook 12 in the hanger 74 is preferably folded about 180° from the extended position.

The operation of the hook 12 of the hanger 74 is identical with that of the hanger 2, as already described above.

Figure 12:
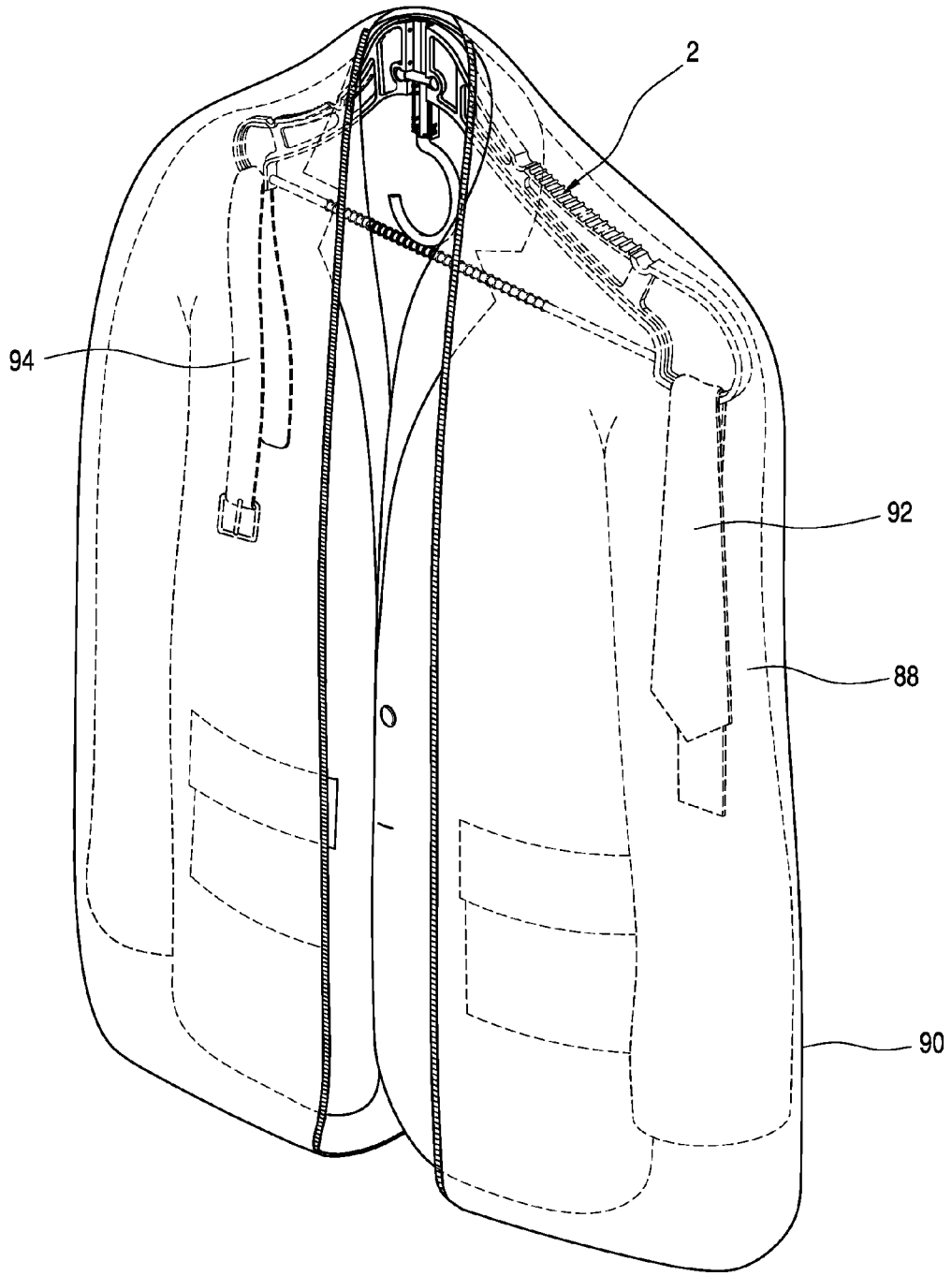
FIG. 12 is a perspective of the space saving hanger of FIG. 1 in the folded position while in use with clothing within a garment bag.

Referring to FIG. 12, the hanger 2 is shown in use with a piece of clothing 88 in a travel garment bag 90. A necktie 92 is shown hanging from the arm portion 6 through the opening 22. A belt 94 is also shown hanging from the arm portion 8 through the other opening 22.

The space saving feature of the hanger 2 is most advantageous for travel when the hanger is packed with the clothing in the garment bag. The hanger 2 in the folded position allows the clothing 88 to occupy the upper portion of the garment bag 90 without much wasted space as compared to a standard hanger with a fixed hook. For a garment bag 90 that is sized for the length of the clothing, the compact configuration of the hanger 2 in the folded position advantageously allows the clothing to fit within the garment bag without folding. Keeping the hanger 2 with the clothing 88 inside the garment bag 90 for travel advantageously provides support to the clothing to minimize crumpling of the clothing from handling during travel and conveniently provides the user with a hanger at the destination.

The space saving, folded position of the hanger 2 is also useful for storage. Several hangers 2 with the respective hooks 12 in the folded position can be placed side by side inside a box without wasted space where the hooks would normally extend in standard hangers. The hangers in the folded position are also easier to handle, since the hooks are out of the way since they are disposed within the respective spaces of the frame 4 and the cross member 18, minimizing snagging of the hooks with each other or the surrounding items.

It should be understood that the hanger 74 is also used in the same way as the hanger 2.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A space saving hanger, comprising:

a) a frame for supporting a garment, said frame including a first arm portion and a second arm portion, said first and second arm portions extending outwardly and downwardly from a central portion of said frame; and b) a hook attached to said central portion, said hook including an extended position and a folded position, said hook extending upwardly from said central portion when in said extended position, said hook extending downwardly from said central portion when in said folded position;

c) said hook including a stem portion and a hook portion;

d) said hook including a shaft portion attached transversely to said stem portion;

e) said shaft portion is pivotably attached to said central portion;

f) ball portions are disposed respectively at each end of said shaft portion; and g) said ball portions are rotatably captured within respective sockets in said central portion.

2. The space saving hanger as in claim 1, wherein said hook is locked to said central portion in said extended position or said folded position.

3. The space saving hanger as in claim 2, wherein:

a) said central portion includes a recess;

b) said stem portion is disposed within said recess when said hook is in said extended position; and c) a cover to cover said recess.

4. The space saving hanger as in claim 3, wherein:

a) said cover includes a base wall and opposing side walls; and b) said stem portion is attached to said base wall.

5. The space saving hanger as in claim 4, wherein:

a) said recess includes opposing side walls above said shaft, said opposing side walls including indentations; and b) said opposing side walls of said cover include projections configured to be received within said indentations when said hook is in said extended position.

6. The space saving hanger as in claim 5, wherein:

a) said opposing side walls include a plurality of slots disposed transversely to said base wall; and b) each of said indentations is disposed between adjacent slots.

7. The space saving hanger as in claim 5, wherein:

a) said opposing side walls of said recess include edges; and b) said base wall is flush with said edges when said hook is in said extended position.

8. The space saving hanger as in claim 5, wherein:

a) said central portion includes a flat surface; and b) said base wall is indented from said flat surface when said hook in in said folded position.

9. The space saving hanger as in claim 4, wherein:

a) said recess includes opposing side walls below said shaft, said opposing side walls include indentations; and b) said opposing side walls of said cover include projections configured to be received within said indentations when said hook is in said folded position.

10. The space saving hanger as in claim 1, wherein said first arm portion and said second arm portion include openings configured to hang other items of clothing.

11. The space saving hanger as in claim 1, wherein said central portion is hollowed.

12. The space saving hanger as in claim 1, wherein said first and second arm portions each includes a series of ribs disposed transversely to said first and second arm portions.

13. The space saving hanger as in claim 1, and further comprising a member disposed between opposite ends of said first and second arm portions.

14. The space saving hanger as in claim 13, wherein:

a) said member is round in cross-section; and b) a plurality of circular ribs disposed circumferentially around said member.

15. The space saving hanger as in claim 13, wherein said hook is disposed within a space defined by said frame and said member when said hook is in said folded position.

16. The space saving hanger as in claim 1, wherein:

a) said first and second arm portions include upper edges; and b) recesses disposed on said upper edges.

17. The space saving hanger as in claim 1, wherein said first and second arm portions are covered with non-slip layer.

18. The space saving hanger as in claim 1, wherein:

a) a horizontal cross-member portion is attached to opposing ends of said first and second arm portion;

b) said horizontal cross-member and said first and second arm portions are rectangular in cross-section; and c) said horizontal cross-member and said first and second arm portions are covered with non-slip layer.

19. The space saving hanger as in claim 1, wherein said hook in said folded position is about 180° apart from the extended position.

* * * * *